US009719472B2

(12) United States Patent
Muehlbauer et al.

(10) Patent No.: US 9,719,472 B2
(45) Date of Patent: Aug. 1, 2017

(54) VALVE ARRANGEMENT

(71) Applicant: Continental Automotive GmbH, Hannover (DE)

(72) Inventors: Andreas Muehlbauer, Bernhardswald (DE); Matthias Bleeck, Pentling (DE); Burhan Dagdelen, Wenzenbach (DE); Joerg Bernhardt, Nuremberg (DE); Juergen Bohmann, Furth i. Wald (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days.

(21) Appl. No.: 14/767,989

(22) PCT Filed: Sep. 29, 2014

(86) PCT No.: PCT/EP2014/070833
§ 371 (c)(1),
(2) Date: Aug. 14, 2015

(87) PCT Pub. No.: WO2015/055410
PCT Pub. Date: Apr. 23, 2015

(65) Prior Publication Data

US 2016/0215744 A1 Jul. 28, 2016

(30) Foreign Application Priority Data

Oct. 15, 2013 (DE) ..... 10 2013 220 768

(51) Int. Cl.
*F02M 59/48* (2006.01)
*F02M 59/36* (2006.01)
(Continued)

(52) U.S. Cl.
CPC ..... *F02M 59/485* (2013.01); *F02M 59/36* (2013.01); *F02M 59/366* (2013.01);
(Continued)

(58) Field of Classification Search
CPC .... F02M 59/485; F02M 59/36; F02M 59/366; F02M 59/44; F02M 59/46; F02M 59/466; F02M 59/48; F04B 1/0452; F04B 53/10
(Continued)

(56) References Cited

U.S. PATENT DOCUMENTS 6,224,350 B1 5/2001 Guentert et al. ..... 417/273
6,554,590 B2 * 4/2003 Maeda ..... F02M 63/0225 123/506
(Continued)

FOREIGN PATENT DOCUMENTS

DE 19729791 A1 1/1999 ..... F02M 59/06
DE 10118755 A1 12/2001 ..... F02M 51/00
(Continued)

OTHER PUBLICATIONS

Korean Office Action, Application No. 2016033847402, 8 pages, May 10, 2016.
(Continued)

*Primary Examiner* — Mahmoud Gimie
(74) *Attorney, Agent, or Firm* — Slayden Grubert Beard PLLC

(57) ABSTRACT

A valve arrangement for a high pressure pump includes a pump housing with a depression, and a valve housing configured to be inserted in the depression, and a clamping disc. The valve housing has at least one radial projection with a first axial boundary surface and a second axial boundary surface arranged opposite the first axial boundary surface, wherein the clamping disc extends radially over the radial projection of the valve housing and has a third axial boundary surface that corresponds with the second axial boundary surface of the valve housing. On the circumferential side, the clamping disc has a thread that can be screwed into a thread on the inner side of the depression to brace the valve housing onto the first boundary surface.

14 Claims, 1 Drawing Sheet

(51) Int. Cl.

| | |
|---|---|
| ***F02M 59/44*** | (2006.01) |
| ***F02M 59/46*** | (2006.01) |
| ***F04B 1/04*** | (2006.01) |
| ***F04B 53/10*** | (2006.01) |
| *F02M 63/02* | (2006.01) |

(52) U.S. Cl.
CPC ..... *F02M 59/44* (2013.01); *F02M 59/46* (2013.01); *F02M 59/466* (2013.01); *F02M 59/48* (2013.01); *F04B 1/0452* (2013.01); *F04B 53/10* (2013.01); *F02M 63/0265* (2013.01); *F02M 2200/8076* (2013.01)

(58) Field of Classification Search
USPC ..... 123/379, 495, 506–508
See application file for complete search history.

(56) References Cited

U.S. PATENT DOCUMENTS

| | | | | |
|---|---|---|---|---|
| 6,648,610 | B2 | 11/2003 | Williams | 417/307 |
| 7,048,521 | B2 | 5/2006 | Kondo | 417/443 |
| 7,509,948 | B1 * | 3/2009 | DePayva | F02M 59/366 123/506 |
| 7,845,617 | B2 * | 12/2010 | Cobianchi | F02M 59/366 251/129.15 |

FOREIGN PATENT DOCUMENTS

| | | | | |
|---|---|---|---|---|
| DE | 10356250 | A1 | 7/2004 | F02M 59/34 |
| DE | 60215994 | T2 | 9/2007 | F02M 55/02 |
| DE | 102009002530 | A1 | 10/2010 | F02M 59/02 |
| DE | 102009029582 | A1 | 3/2011 | F02M 55/04 |
| DE | 102010031600 | A1 | 1/2012 | F02M 59/46 |
| DE | 102011089857 | A1 | 6/2013 | F02M 59/44 |
| EP | 1722101 | A1 | 11/2006 | F02M 47/00 |
| JP | 1037822 | A | 2/1998 | F02M 37/00 |
| WO | 2013/079693 | A1 | 6/2013 | F02M 59/36 |
| WO | 2015/055410 | A1 | 4/2015 | F02M 59/36 |

OTHER PUBLICATIONS

German Office Action, Application No. 102013220768.9, 6 pages, Aug. 11, 2014.

International Search Report and Written Opinion, Application No. PCT/EP2014/070833, 15 pages, Dec. 12, 2014.

* cited by examiner

VALVE ARRANGEMENT

CROSS-REFERENCE TO RELATED APPLICATIONS

This application is a U.S. National Stage Application of International Application No. PCT/EP2014/070833 filed Sep. 29, 2014, which designates the United States of America, and claims priority to DE Application No. 10 2013 220 768.9 filed Oct. 15, 2013, the contents of which are hereby incorporated by reference in their entirety.

TECHNICAL FIELD

The invention relates to a valve arrangement, in particular a valve arrangement for a high pressure pump for a common rail system.

BACKGROUND

Injection systems known as common rail systems for injecting fuel into combustion chambers of an internal combustion engine, in particular a diesel engine, have a pressurized fuel accumulator, the common rail. In order to supply it continuously with fuel, a high pressure pump is required.

In addition to a piston which is driven via an eccentric, a high pressure pump also has a valve arrangement with active or passive valves. The valve arrangement is usually integrated directly into the pump by way of a high degree of integration in a sandwich design, which takes place, for instance, with the aid of pressing and welding operations and accompanying setting processes. In the case of manufacturing of this type, however, the valve arrangement can be tested only directly in the pump, with the result that the entire pump becomes a reject in the case of malfunctions of the valve.

It is known from WO 2013/079693 A1 to attach a valve to a high pressure pump with the aid of a central thread such that it can be disassembled. As a result of the arrangement of the central thread on a valve housing and as a result of the required use of sealing rings on the valve housing, the latter experience a rotational/translational movement during assembly and can become jammed or damaged in the process.

SUMMARY

One embodiment provides a valve arrangement for a high pressure pump, having a pump housing with a depression, a valve housing which is configured so as to correspond with the depression in the pump housing, with the result that it can be inserted into the depression, and a clamping disk, wherein the valve housing has at least one radial projection with a first axial bounding face and a second axial bounding face which is arranged so as to lie opposite the former, wherein the clamping disk extends radially over the radial projection of the valve housing and has a third axial bounding face which rests flush on the second axial bounding face of the valve housing, and wherein the clamping disk has a thread on the circumferential side, which thread can be screwed into a thread on the inner side of the depression in such a way that the valve housing is braced in the pump housing via the clamping disk.

In a further embodiment, the depression has a shoulder, on which the first axial bounding face of the valve housing rests.

In a further embodiment, the depression in the pump housing has a further shoulder for receiving a cylindrical section of the valve housing.

In a further embodiment, the valve housing has an annular ring groove which is arranged on the circumferential side in a cylindrical section and in which a sealing ring is arranged.

In a further embodiment, a supporting ring is arranged in the ring groove.

In a further embodiment, the second axial bounding face of the valve housing which faces the clamping disk has a shoulder which extends axially toward the clamping disk and corresponds with a shoulder on the third axial bounding face on the clamping disk, with the result that the valve housing is centered on the clamping disk.

In a further embodiment, the clamping disk has a fourth axial bounding face which is arranged so as to lie opposite the third axial bounding face and which is equipped with a receiving profile for a tool.

In a further embodiment, the valve housing and the clamping disk each include one bore, the bores merging into one another and the diameters corresponding with one another.

Another embodiment provides a high pressure pump having a valve arrangement as discussed above for a common rail system.

BRIEF DESCRIPTION OF THE DRAWINGS

Example embodiments are discussed below with reference to the drawings, in which.

DETAILED DESCRIPTION

Figure 1:
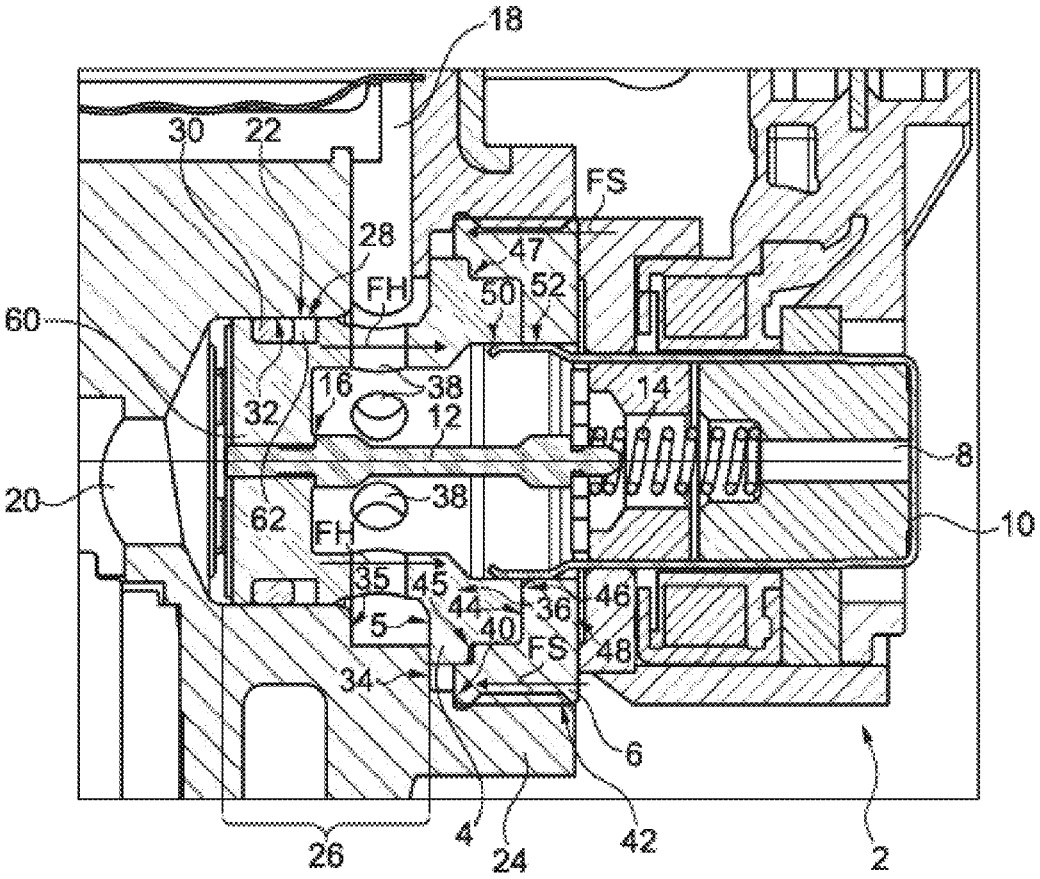
FIG. 1 shows the valve arrangement in a sectional illustration.

Embodiments of the invention provide a valve arrangement for a pump, which valve arrangement allows fastening on or in a pump in a manner which is as reliable as possible and which furthermore permits disassembly, which valve arrangement at the same time prevents assembly-induced damage of sealing rings and nevertheless has a construction which is as compact as possible.

A valve arrangement for a high pressure pump is proposed, which has a pump housing with a depression, a valve housing which is configured so as to correspond with the depression in the pump housing, with the result that it can be inserted into the depression, and a clamping disk. The valve housing has at least one radial projection with a first axial bounding face and a second axial bounding face which is arranged so as to lie opposite the former. The clamping disk extends radially over the radial projection of the valve housing and has a third axial bounding face which rests flush on the second axial bounding face of the valve housing. The clamping disk has a thread on the circumferential side, which thread can be screwed into a thread on the inner side of the depression in such a way that the valve housing is braced by way of the first axial bounding face in the pump housing via the clamping disk.

The valve housing is configured such that it can be plugged or pushed into the depression of the pump housing as a result of the corresponding configuration. The bounding faces between the valve housing and the pump housing can be configured with conventional sealing rings or the like which are not moved rotationally in the pump housing on account of the absence of a screw connection of the valve housing. The reliability of the sealing action of the sealing rings is therefore not influenced by the type of assembly.

The radial projection of the valve housing is suitable for carrying out bracing of the valve housing with the pump housing via the clamping disk which can be screwed into the pump housing. On account of the high operating pressure in high pressure pumps of 350 bar or more, relatively great axial forces act on the valve which have to be absorbed by the fastening means of the valve housing. The arrangement of a thread on the circumferential side and the bracing of the valve housing with the pump housing leads to considerably more favorable absorbing of said axial forces, and the displacement of the thread radially to the outside, furthermore, requires considerably smaller dimensioning of the thread and therefore permits a compact design of the valve arrangement.

In one embodiment, the depression has a shoulder, on which the first axial bounding face of the valve housing rests. As a consequence, said shoulder can provide an annular bounding face for bracing the valve housing in the pump housing. The shoulder is preferably a step-shaped transition from a relatively large internal diameter to a relatively small internal diameter. The relatively large internal diameter might be approximately the internal diameter of the thread in the depression or might be smaller than the latter.

For improved centering of the valve housing in the pump housing, the depression can have a further shoulder which leads to a blind bore-like design of the inner section of the depression. A cylindrical section of a valve housing can be introduced easily into said section; the valve housing should be capable of being introduced easily into the depression. Said inner section of the depression is called a sealing section in the following text.

The sealing section is particularly preferably configured with a locating fit which is suitable for sealing via a sealing ring, the valve housing having an annular ring groove which is arranged on the circumferential side in a corresponding, cylindrical section, in which ring groove a sealing ring is arranged. During pushing of the valve housing into the sealing section, squashing of the sealing ring and, as a consequence, sealing between the sealing section and the valve housing take place. As stated in the preceding text, a continuous rotation of the sealing ring during assembly is avoided by way of the pushing-in action. It can therefore virtually be ruled out that the sealing action is impaired in an assembly-induced manner.

A supporting ring can further advantageously be arranged in the ring groove, which supporting ring prevents extrusion of the sealing ring into a sealing gap which is formed between the ring groove and the depression.

In one embodiment, that second axial bounding face of the valve housing which faces the clamping disk has a shoulder which extends axially toward the clamping disk. As a consequence, the third axial bounding face on the clamping disk can likewise have a shoulder which corresponds with the shoulder on the second bounding face of the valve housing. A centering action can thus additionally be produced in this way, as a result of which centering action a particularly precise orientation of the valve housing is produced and/or maintained during screwing of the clamping disk to the pump housing.

Planar contact of the bounding faces, which are therefore particularly simple to produce, would be conceivable as a further embodiment.

In one embodiment, the clamping disk has a fourth axial bounding face which is arranged so as to lie opposite the third axial bounding face and which is equipped with a receiving profile for a tool. Since the valve components can extend through the clamping disk axially over the pump housing and the clamping disk might dip, furthermore, virtually completely into the pump housing, it is particularly advantageous if a corresponding tool for screwing the clamping disk can be arranged releasably on the clamping disk. This is achieved by way of a profile of this type for receiving a tool which can have completely different shapes. In addition to bores which are spaced apart from a rotational axis and between which a type of pronged wrench can be arranged, regular, continuous profiles are also conceivable, such as a star-shaped recess, for instance.

It is preferred, furthermore, that the valve housing and the clamping disk have in each case one bore, the diameters of which correspond with one another. Here, an actuator housing of an actuator of a volumetric flow control valve might be plugged, for instance, through the two corresponding bores into the valve housing and clamped to the latter. Coils of a control electromagnet can be arranged around said actuator housing. A further housing which surrounds the magnet might be screwed to the clamping disk, furthermore.

Another embodiment provides a high pressure pump having a valve arrangement of this type. Here, the high pressure pump is, in particular, the high pressure pump of a common rail system.

The refinements and developments which are described can be combined with one another in any desired manner.

Further embodiments, refinements, developments and implementations of the invention also comprise combinations which are not explicitly mentioned of features of the invention which are described above or which will be described in the following text with regard to the exemplary embodiments.

FIG. 1 shows a valve arrangement 2 having a valve housing 4, a clamping disk 6 and an actuator 8 in an actuator housing 10. A core component of the valve arrangement 2 is a valve tappet 12 which is pressed onto a stop 16 via a spring 14, it being possible for the actuator 8 to perform an axial movement of the valve tappet 12 counter to the spring force. The opening area between the valve tappet 12 and the valve seat 60 is controlled via the actuator 8 depending on an electric control current. In this way, the magnitude of the volumetric flow from a fluid inlet 18 to an outlet 20 is controlled.

In order for it to be possible to test and/or replace the individual components of the valve arrangement 2 separately, the disclosed valve arrangement 2 has a mechanical separation of functions which leads to the construction which is shown. The valve housing 4 is configured in such a way that it can be plugged into a depression 22 of a pump housing 24. This means that the valve housing 4 can be pushed into the depression 22 by way of an axial movement and no rotation is necessary here, for example for screwing. The depression 22 is provided with a flat bottom or conical bottom in the manner of a blind bore, the outlet 20 adjoining it.

The depression 22 is of cylindrical configuration in the region of the outlet 20; the valve housing 4 likewise has a cylindrical section 26, the external diameter of which corresponds to the internal diameter of the depression 22. The cylindrical section 26 has a ring groove 28 which is arranged on the circumferential side with a supporting ring 61, which supports a sealing ring 30. As a result of the valve housing 4 being pushed into the depression 22, the sealing ring 30 is compressed slightly and, as a result, it is pressed flush both onto the supporting ring 61 in the ring groove 28 and onto the corresponding sealing face 32 of the pump housing 24. A desired sealing action is produced in this way.

The pump housing 24 has a shoulder 34, the inner diameter of the shoulder 34 being smaller than the outer diameter of the projection 36 of the valve housing 4. As a result, during pushing into the depression 22, the valve housing 4 comes into contact by way of a first axial bounding face 5 with the shoulder 34, with the result that the geometric positions of inflow channels from the inlet 18 correspond with the throughflow openings 38 of the valve housing 4.

The clamping ring 6 is used to brace the valve housing 4 with the pump housing 24. Said clamping ring 6 is configured in such a way that a thread 40 is arranged on the circumferential side on its outer side, which thread 40 corresponds with a thread 42 of the pump housing 24. The hydraulic force FH which is produced by way of the high pressure of a common rail system is compensated for by way of an axial clamping force FS which is applied with the aid of the clamping ring 6.

On a side which faces the clamping ring 6, the valve housing 4 has a second axial bounding face 44 which corresponds with a third axial bounding face 46 on a side of the clamping ring 6 which faces the valve housing 4. During screwing, the clamping ring 6 therefore bears by way of the third axial bounding face 46 on the second axial bounding face.

The second axial bounding face 44 can be delimited by way of a shoulder 45 which forms an annular plateau which faces away from the clamping ring 6. A shoulder 47 of the clamping ring 6 can correspond therewith, with the result that centering of the valve housing 4 takes place automatically during bracing of the clamping ring 6.

There are tool receiving profiles (not shown here) on a fourth bounding face 48 which is arranged so as to lie opposite the third bounding face 46, which tool receiving profiles allow an application of a tightening torque to the clamping disk 6. The clamping disk 6 is preferably dimensioned in such a way that, in a braced state of the valve housing 4, said clamping disk terminates flush with the pump housing 24 or even dips slightly into the latter.

Furthermore, the valve housing 4 and the clamping disk 6 have in each case one central bore 50 and 52, respectively, which have the same diameter, with the result that the actuator housing 10 can be plugged into the two bores 50 and 52 which are aligned with one another. The remaining components of the actuator 8 can be fastened to the clamping disk 6 after assembly of the actuator housing 10.

As a result of the functional separation of the seal via the sealing ring 30 and the bracing of the valve housing 4 via the clamping disk 6, the valve arrangement can be of considerably shorter and substantially more compact configuration as an independent hydraulic module. This is achieved by way of the relocation of the thread on a component which is relocated from the valve housing and has a considerably greater external diameter than the cylindrical section 26. As a consequence, a shorter thread is necessary in order to introduce the same clamping force. In addition, the valve housing 4 merely has to be plugged in and a rotation of the valve housing 4 is dispensed with, which has an advantageous effect on the sealing action of the sealing ring 30.

Figures 2A, 2B, 2C:
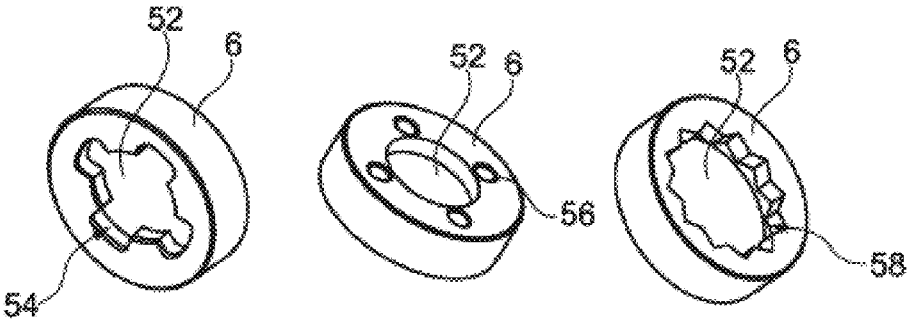
FIGS. 2*a* to 2*c* show clamping disks of different configuration having receiving profiles for receiving a tool.

FIGS. 2*a*-2*c* show different receiving profiles 54, 56 and 58 in a clamping disk 6, which receiving profiles 54, 56 and 58 are configured for receiving a tool. Whereas FIG. 2*a* shows four recesses 54 on the bore 52 which extend radially to the outside, it is proposed in FIG. 2*b* to use separate bores 56 which are spaced apart radially from the bore 52. FIG. 2*c* shows a row of triangular recesses 58 which are arranged on the circumferential side of the bore 52 and widen the bore 52 to form a toothed profile. It goes without saying that other receiving profiles are also conceivable without departing from the core concept of the invention. However, a common feature of all receiving profiles should be that a spacing is maintained from a rotational axis of the clamping disk 6 and at least two recesses should be present, in order to permit the introduction of the tool outside the central bore 52.

Although the present invention has been described in the above text using preferred exemplary embodiments, it is not restricted hereto, but rather can be modified in a wide variety of ways. In particular, the invention can be amended or modified in various ways, without departing from the core concept of the invention.

What is claimed is:

1. A valve arrangement for a high pressure pump, the valve arrangement comprising:

a pump housing having a depression, a valve housing with a central through bore, the valve housing configured to be inserted into the depression, and a clamping disk with a central through bore matching the central through bore of the valve housing in diameter, wherein the valve housing has at least one radial projection with a first axial bounding face and a second axial bounding face arranged opposite the first axial bounding face, wherein the clamping disk extends radially over the at least one radial projection of the valve housing and has a third axial bounding face that rests flush on the second axial bounding face of the valve housing, and wherein the clamping disk includes a thread on a circumferential side of the clamping disk, wherein the thread is configured to be screwed into a thread on an inner side of the depression to secure the valve housing in the pump housing via the clamping disk.

2. The valve arrangement of claim 1, wherein the first axial bounding face of the valve housing rests on a first shoulder of the depression.

3. The valve arrangement of claim 2, wherein the depression in the pump housing includes a second shoulder configured to receive a cylindrical section of the valve housing.

4. The valve arrangement of claim 1, wherein the valve housing has an annular ring groove arranged on a circumferential side in a cylindrical section, wherein a sealing ring is arranged in the annular ring groove.

5. The valve arrangement of claim 4, wherein a supporting ring is also arranged in the annular ring groove.

6. The valve arrangement of claim 1, wherein the second axial bounding face of the valve housing which faces the clamping disk has a shoulder that extends axially toward the clamping disk and corresponds with a shoulder on the third axial bounding face on the clamping disk, such that the valve housing is centered on the clamping disk.

7. The valve arrangement of claim 1, wherein the clamping disk has a fourth axial bounding face arranged opposite the third axial bounding face and having a receiving profile corresponding to a tool.

8. An injection system, comprising:

a common rail, and a high pressure pump having a valve arrangement comprising:

a pump housing having a depression, a valve housing with a central through bore, the valve housing configured to be inserted into the depression, and a clamping disk with a central through bore matching the central through bore of the valve housing in diameter, wherein the valve housing has at least one radial projection with a first axial bounding face and a second axial bounding face arranged opposite the first axial bounding face, wherein the clamping disk extends radially over the at least one radial projection of the valve housing and has a third axial bounding face that rests flush on the second axial bounding face of the valve housing, and wherein the clamping disk includes a thread on a circumferential side of the clamping disk, wherein the thread is configured to be screwed into a thread on an inner side of the depression to secure the valve housing in the pump housing via the clamping disk.

9. The injection system of claim 8, wherein the first axial bounding face of the valve housing rests on a first shoulder of the depression.

10. The injection system of claim 9, wherein the depression in the pump housing includes a second shoulder configured to receive a cylindrical section of the valve housing.

11. The injection system of claim 8, wherein the valve housing has an annular ring groove arranged on a circumferential side in a cylindrical section, wherein a sealing ring is arranged in the annular ring groove.

12. The injection system of claim 11, wherein a supporting ring is also arranged in the annular ring groove.

13. The injection system of claim 8, wherein the second axial bounding face of the valve housing which faces the clamping disk has a shoulder that extends axially toward the clamping disk and corresponds with a shoulder on the third axial bounding face on the clamping disk, such that the valve housing is centered on the clamping disk.

14. The injection system of claim 8, wherein the clamping disk has a fourth axial bounding face arranged opposite the third axial bounding face and having a receiving profile corresponding to a tool.

* * * * *